US010177472B2

(12) United States Patent
Yu

(10) Patent No.: US 10,177,472 B2
(45) Date of Patent: Jan. 8, 2019

(54) SPRING CONTACT HAVING SEPARATE RESILIENT ARM AND SUPPORTING PORTION

(71) Applicant: FOXCONN INTERCONNECT TECHNOLOGY LIMITED, Grand Cayman (KY)

(72) Inventor: Yang-Yang Yu, KunShan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/686,181

(22) Filed: Aug. 25, 2017

(65) Prior Publication Data

US 2018/0062286 A1 Mar. 1, 2018

(30) Foreign Application Priority Data

Aug. 26, 2016 (CN) ..... 2016 2 0948050 U

(51) Int. Cl.

| | |
|---|---|
| ***H01R 13/56*** | (2006.01) |
| ***H01R 12/57*** | (2011.01) |
| *H01R 13/187* | (2006.01) |
| *H01R 13/24* | (2006.01) |
| *H01R 13/17* | (2006.01) |

(52) U.S. Cl.

CPC ..... *H01R 12/57* (2013.01); *H01R 13/245* (2013.01); *H01R 13/17* (2013.01); *H01R 13/187* (2013.01); *H01R 13/2442* (2013.01); *H01R 13/562* (2013.01); *H01R 13/565* (2013.01)

(58) Field of Classification Search

CPC .... H01R 13/562; H01R 13/565; H01R 13/17; H01R 13/2442; H01R 13/187; F16D 13/583; F16F 1/324

USPC ..... 439/474, 862; 267/163

See application file for complete search history.

(56) References Cited

U.S. PATENT DOCUMENTS 5,213,314 A * 5/1993 Kano ..... H01M 2/20 200/284

FOREIGN PATENT DOCUMENTS

| | | | |
|---|---|---|---|
| CN | 201397933 | | 2/2010 |
| CN | 203721945 | | 7/2014 |
| CN | 203721945 U | * | 7/2014 |
| TW | M378513 | | 4/2010 |

* cited by examiner

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

A spring contact includes: a main part (11); plural legs (12, 13) extending downward from two opposite sides of the main part; a resilient arm (14) extending upward from a rear end of the main part, the resilient arm having a contact portion; and a pair of supporting portions (15) extending from the two opposite sides of the main part and located in front of the resilient arm; wherein the supporting portions are separate from the resilient arm.

9 Claims, 5 Drawing Sheets

SPRING CONTACT HAVING SEPARATE RESILIENT ARM AND SUPPORTING PORTION

BACKGROUND OF THE INVENTION

1. Field of the Invention

The present invention relates to a spring contact having a main part, a resilient arm extending from the main part, and a pair of supporting portions extending from the main part and separate from the resilient arm.

2. Description of Related Arts

U.S. Pat. No. 5,213,314 discloses a spring contact device including an insulative case and a spring contact securely attached to the insulative case. The spring contact has a U-shaped leaf spring portion and a pair of barbed lugs extending upwardly from opposite sides of a lower section of the U-shaped leaf spring portion.

China Patent No. 201397933 discloses a contact terminal including a base part, a connecting part, a spring part, a contact part, a soldering part, and an adjusting part between the base part and the soldering part. The height of the contact terminal can be changed by selecting a desired height of the adjusting part.

China Patent No. 203721945 discloses a terminal comprising a base plate, two side plates, a plurality of soldering feet, and an elastic contact arm. Each side plate includes an enclosed opening bordered by an upper rim and a lower rim. The elastic contact arm includes a contact portion and a pair of side protruding portions. The side protruding portions are confined in the opening so that the elastic contact arm is resiliently movable between the upper and lower rims. The upper rim pre-loads the elastic contact arm while the lower rim prevents over-stressing the elastic contact arm.

A spring contact of a different construction is desired.

SUMMARY OF THE INVENTION

A spring contact comprises: a main part; a plurality of legs extending downward from two opposite sides of the main part; a resilient arm extending upward from a rear end of the main part, the resilient arm having a contact portion; and a pair of supporting portions extending from the two opposite sides of the main part and located in front of the resilient arm; wherein the supporting portions are separate from the resilient arm.

DETAILED DESCRIPTION OF THE PREFERRED EMBODIMENT

Figure 1:
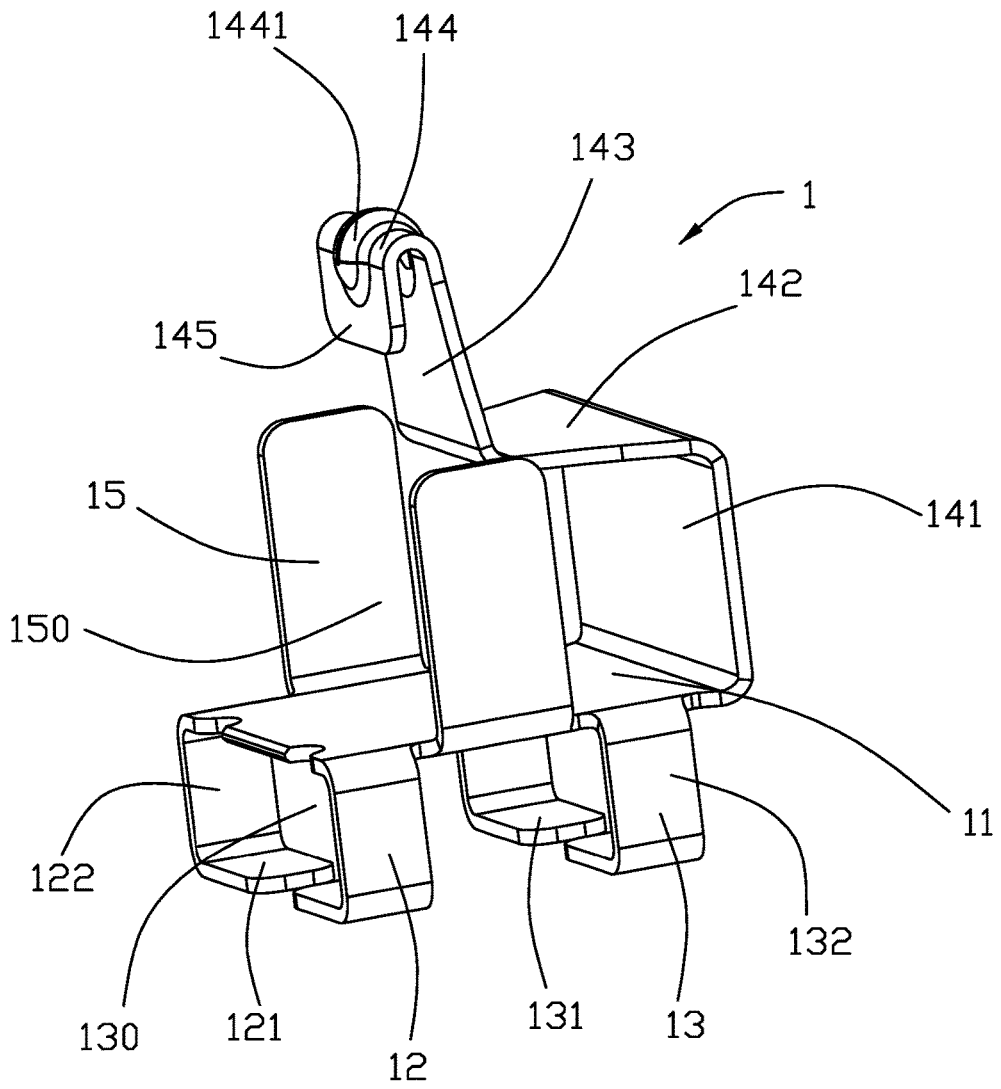
FIG. 1 is a perspective view of a spring contact in accordance with the present invention.
Figure 2:
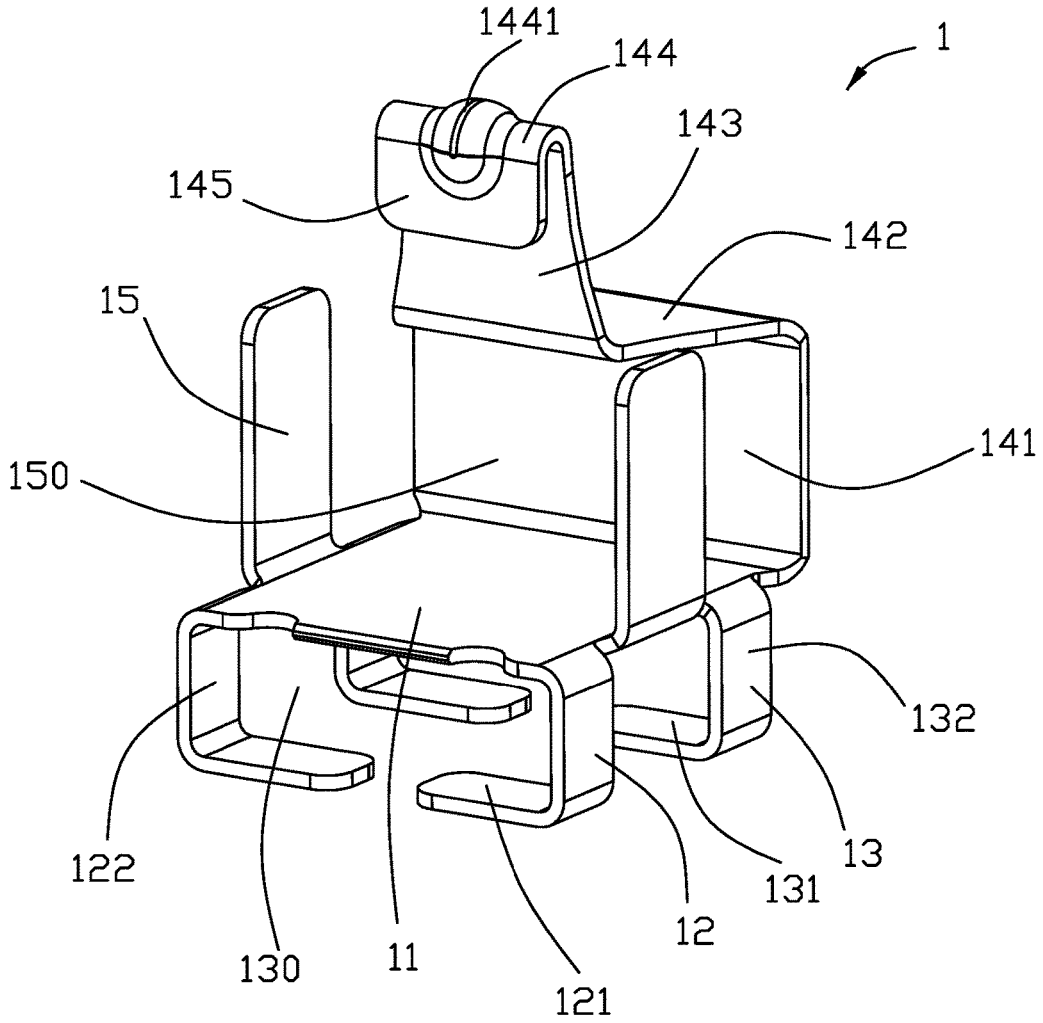
FIG. 2 is a further perspective view of the spring contact.
Figure 3:
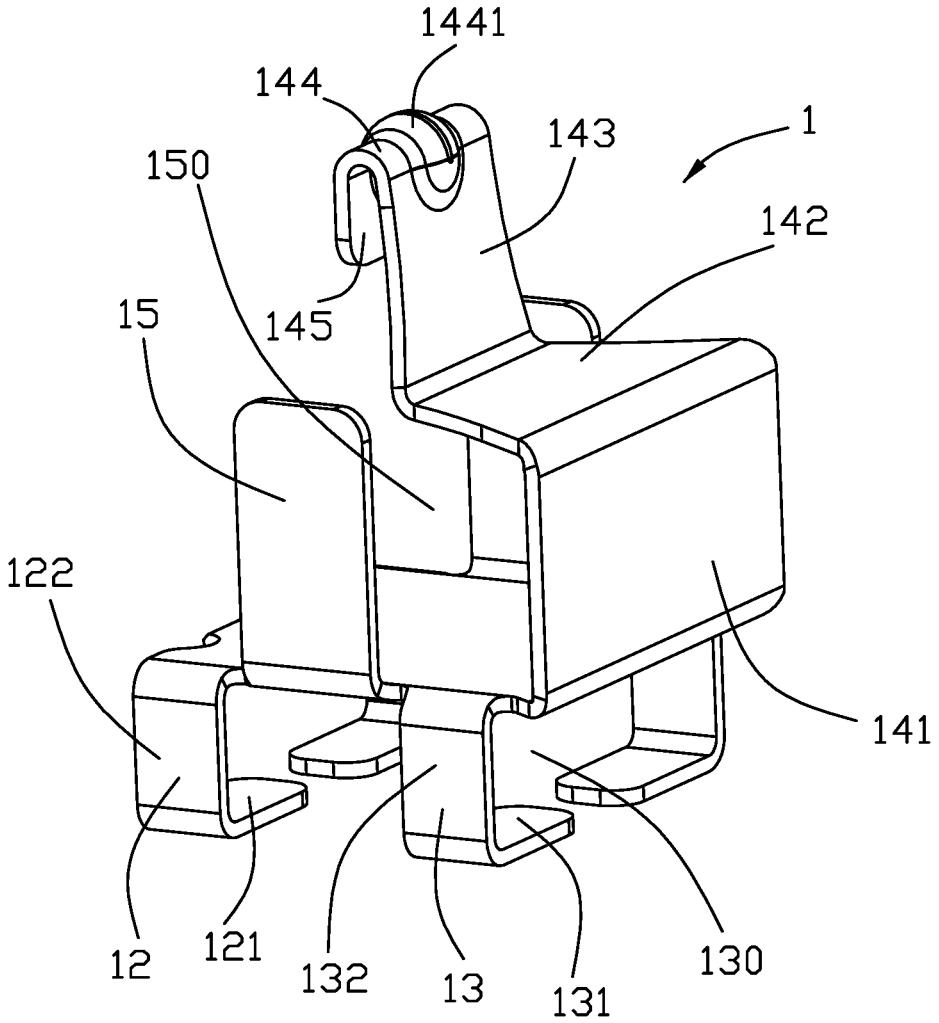
FIG. 3 is another perspective view of the spring contact.
Figure 4:
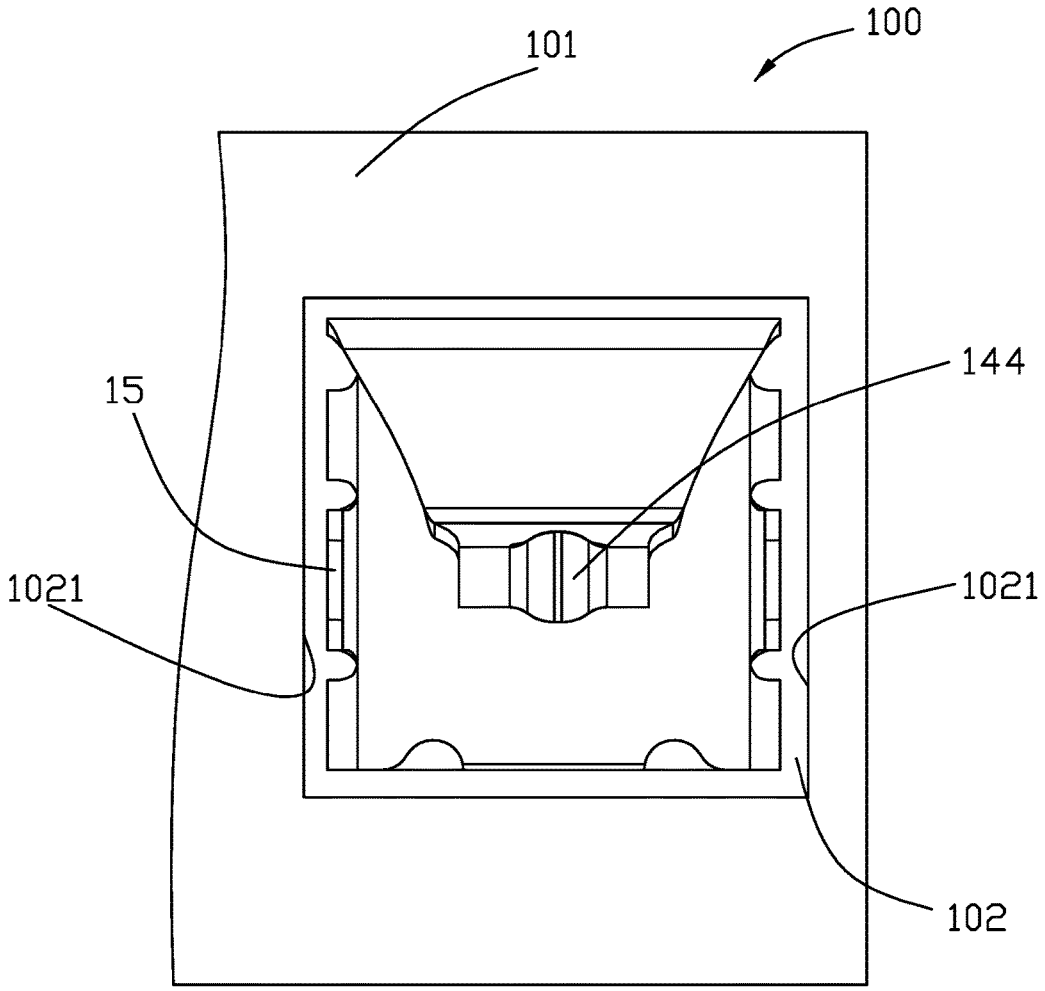
FIG. 4 is a top view of the spring contact extending through a device.
Figure 5:
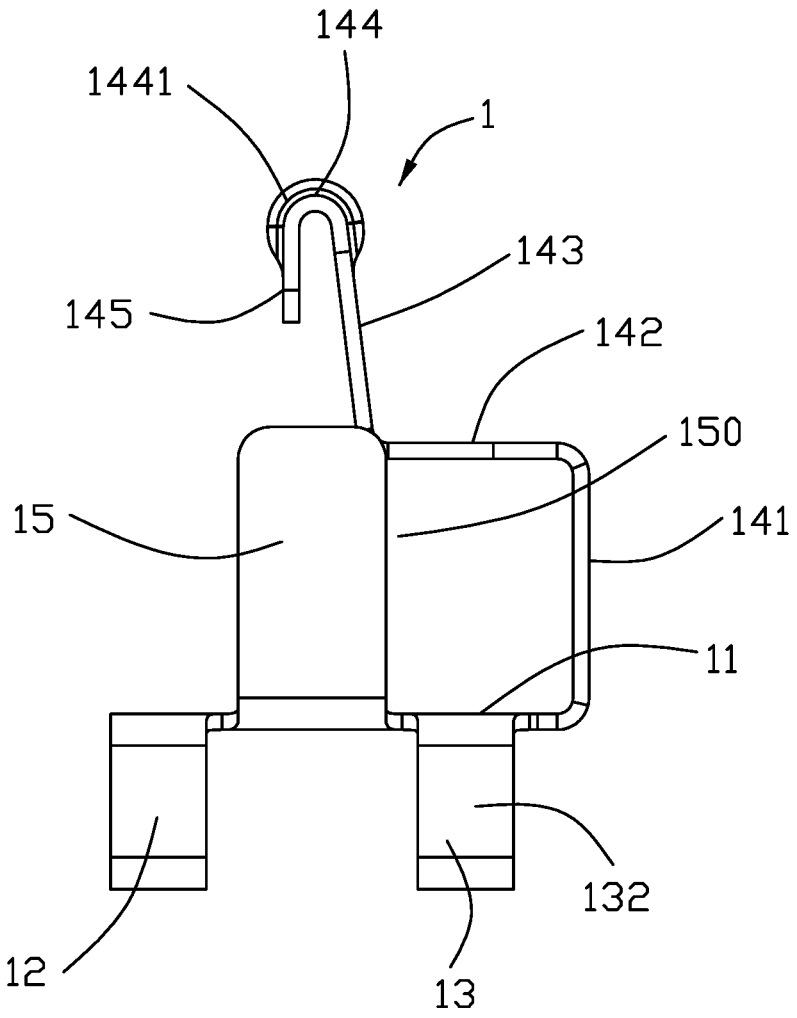
FIG. 5 is a cross-sectional view of the spring contact of FIG. 1.

Referring to FIGS. 1-5 in general, and particularly to FIGS. 1 and 4, a spring contact device 100 includes an insulative housing 101 for a spring contact 1 to extend through. The insulative housing 101 has a corresponding contact aperture 102. The spring contact 1, to be soldered to a printed circuit board for grounding purpose, includes a horizontal main part or plate 11 forming a rectangular configuration with thereof opposite long sides and opposite short sides wherein the long side extends along a lengthwise direction and the short side extends along the transverse direction perpendicular to the lengthwise direction, a plurality of legs 12 and 13 extending vertically downward from two opposite (long) sides of the main part 11, a resilient arm 14 extending upward from a rear end or a short side of the main part 11, and a pair of supporting portions 15 extending from the two sides of the main part 11 and located generally in front of the resilient arm 14. The aperture 102 has two opposite side walls 1021.

As shown in FIG. 1, the plurality of legs include a pair of front legs 12 and a pair of rear legs 13 and extend downward opposite to the supporting portions 15. The legs 12 and 13 are to be soldered to a printed circuit board. The leg 12 has a vertical part 122 and a horizontal part 121; the leg 13 has a vertical part 132 and a horizontal part 131. The vertical parts 122 and 132 may be selected to have a desired height.

As shown in FIGS. 1-3, the supporting portion 15 is located between a corresponding front leg 12 and a corresponding rear leg 13. The supporting portions 15 do not touch the side walls 1021 of the aperture 102. Nor do the supporting portions 15 engage or touch physically the resilient arm 14.

In use, the resilient arm 14 is to be pressed by a cell phone, e.g., a rear cover thereof. The resilient arm 14 includes a substantially vertical first portion 141 extending from the rear end of the main part 11, a substantially horizontal second portion 142 continuing the first portion 141, an inclined arm portion 143 continuing the second portion 142, a contact portion 144 continuing the arm portion 143, and a hook portion 145 continuing the contact portion 144. The contact portion 144 has a protrusion 1441. A width of the arm portion 143 is less than a distance between the two supporting portions 15. A height (vertical length) of the arm portion 143 is less than a height of the supporting portion 15. A space 150 for movement of the resilient arm 14 is generally defined by the first portion 141, the second portion 142, the supporting portions 15, and the main part 11.

The height of the supporting portion 15 is effective to stop a further resilient movement of the resilient arm 14 in the space 150 when the contact portion 144 is pressed by an external force to move toward the main part 11. For example, a cell phone rear cover will be stopped by the supporting portions 15 so that the resilient arm 14 will not be permanently deformed. In other words, the contact portion 144 may be downwardly pressed to a level coplanar with the top edge of the supporting portion 15. Notably, according to FIGS. 4 and 5, the contact portion 144 is aligned with a space defined between the pair of supporting portions 15 in the transverse direction, thus properly confining the resilient arm 14 when the resilient arm 14 is downwardly pressed in the vertical direction and confronts the pair of supporting portions in the transverse direction.

Once a height of the vertical parts 122 and 132 is selected, the horizontal parts 121 and 131 are soldered to a printed circuit board. Notably, a space 130 is formed among the main part 11, the pair of front legs 12 and the pair of rear legs 13.

What is claimed is:

1. A spring contact comprising:

a horizontal main plate defining a rectangular configuration with thereof opposite long sides and opposite short sides wherein the long side extends in a lengthwise direction and the short side extends along a transverse direction perpendicular to the lengthwise direction;

a pair of front legs and a pair of rear legs respectively extending from opposite long sides and spaced from each other in the lengthwise direction, said pair of front legs having a pair of front vertical parts respectively extending downwardly from the corresponding long sides in a vertical direction perpendicular to both said lengthwise direction and said transverse direction and a pair of front horizontal parts respectively extending horizontally from the pair of front vertical parts and toward each other in the transverse direction, said pair of rear legs having a pair of rear vertical parts respectively extending downwardly from the corresponding long sides in the vertical direction and a pair of rear horizontal parts respectively horizontally extending from the pair of rear vertical parts and toward each other in the transverse direction;

a pair of supporting portions respectively extending upwardly from the opposite long sides and between the pair of corresponding front legs and the pair of rear legs in the lengthwise direction in a symmetrical manner; and a resilient arm upwardly extending from one of said short sides and including an upward contact portion, wherein said upward contact portion is capable of being moved downwardly until reaching a level defined by corresponding top ends of said pair of supporting portions without permanent deformation; wherein the contact portion is aligned, in the vertical direction, with a space which is defined between the pair of supporting portions in the transverse direction so as to have the contact portion directly confront said pair of supporting portions in the transverse direction.

2. The spring contact as claimed in claim 1, wherein the resilient arm includes a first portion upwardly extending from the short side with a width the same as the short side in the transverse direction, a second portion extending from the first portion horizontally in the lengthwise direction, and an inclined arm portion linked between the contact portion and the second portion.

3. The spring contact as claimed in claim 2, wherein a width of the inclined arm portion and that of the contact portion are smaller than a dimension of the short side in said transverse direction so as to allow downward movement of the contact portion.

4. The spring contact as claimed in claim 3, wherein both said contact portion and said inclined arm portion are moveable between the pair of supporting portions when the resilient arm portion is downwardly pressed.

5. A spring contact comprising:

a horizontal main plate defining a rectangular configuration with thereof opposite long sides and opposite short sides wherein the long side extends in a lengthwise direction and the short side extends along a transverse direction perpendicular to the lengthwise direction;

a pair of front legs and a pair of rear legs respectively extending from opposite long sides and spaced from each other in the lengthwise direction, said pair of front legs having a pair of front vertical parts respectively extending downwardly from the corresponding long sides in a vertical direction perpendicular to both said lengthwise direction and said transverse direction and a pair of front horizontal parts respectively extending horizontally from the pair of front vertical parts and toward each other in the transverse direction, said pair of rear legs having a pair of rear vertical parts respectively extending downwardly from the corresponding long sides in the vertical direction and a pair of rear horizontal parts respectively extending horizontally from the pair of rear vertical parts and toward each other in the transverse direction;

a pair of supporting portions respectively extending upwardly from the opposite long sides and between the pair of corresponding front legs and the pair of rear legs in the lengthwise direction in a symmetrical manner; and a resilient arm upwardly extending from one of said short sides and including an upward contact portion, wherein said contact portion is aligned, in the vertical direction, with a space which is defined between the said pair of supporting portions in the transverse direction so as to have the resilient arm confined therein and directly confronting the pair of supporting portions in the transverse direction when said contact portion is downwardly pressed in the vertical direction.

6. The spring contact as claimed in claim 5, wherein the resilient arm further includes an inclined arm portion respectively linked directly to the contact portion and linked indirectly to the main plate via at least a first portion thereof, and said inclined arm portion is confined between said pair of supporting portions in the transverse direction when the resilient arm is downwardly pressed.

7. The spring contact as claimed in claim 6, wherein said first portion extends upwardly in the vertical direction from the short side.

8. The spring contact as claimed in claim 7, wherein said resilient arm further includes a second portion linked between the first portion and the inclined arm portion and horizontally extending in the lengthwise direction.

9. The spring contact as claimed in claim 7, wherein a height of the supporting portion is effective to stop a further resilient movement of the resilient arm in the space when the contact portion is pressed by an external force to move toward the main part.

* * * * *